US008222556B2

(12) United States Patent
Akesson et al.

(10) Patent No.: US 8,222,556 B2
(45) Date of Patent: Jul. 17, 2012

(54) CIRCUIT BREAKER

(75) Inventors: Ulf Akesson, Ludvika (SE); Dag Andersson, Ludvika (SE); Leif Skold, Ludvika (SE); Yngve Petersson, Ludvika (SE)

(73) Assignee: ABB Technology Ltd. (CH)

( * ) Notice: Subject to any disclaimer, the term of this patent is extended or adjusted under 35 U.S.C. 154(b) by 497 days.

(21) Appl. No.: 12/492,954

(22) Filed: Jun. 26, 2009

(65) Prior Publication Data

US 2009/0321392 A1 Dec. 31, 2009

Related U.S. Application Data

(63) Continuation of application No. PCT/EP2007/064320, filed on Dec. 20, 2007.

(30) Foreign Application Priority Data

Dec. 29, 2006 (EP) ..... 06445080

(51) Int. Cl.
*H01H 33/02* (2006.01)

(52) U.S. Cl. ..... 218/143; 218/140

(58) Field of Classification Search ..... 218/143, 218/7, 9, 14, 43, 44, 152–155; 324/424, 324/107, 126, 127

See application file for complete search history.

(56) References Cited

U.S. PATENT DOCUMENTS

| | | | | |
|---|---|---|---|---|
| 368,567 | A | 8/1887 | Brock | |
| 4,124,790 | A * | 11/1978 | Kumbera et al. | 218/138 |
| 6,091,040 | A * | 7/2000 | Mascher | 218/155 |
| 6,608,481 | B1 * | 8/2003 | Piazza et al. | 218/63 |

FOREIGN PATENT DOCUMENTS

| | | | |
|---|---|---|---|
| GB | 336452 | A | 10/1930 |
| GB | 864835 | A | 4/1961 |
| WO | 0008664 | A1 | 2/2000 |

OTHER PUBLICATIONS

International Search Report and Written Opinion of the International Searching Authority; PCT/EP2007/064320; May 2, 2008; 7 pages.

* cited by examiner

*Primary Examiner* — Renee S Luebke
*Assistant Examiner* — Marina Fishman
(74) *Attorney, Agent, or Firm* — St. Onge Steward Johnston & Reens LLC

(57) ABSTRACT

A circuit breaker for high voltage applications, including: at least one breaking unit, a supporting insulator having one end on ground potential and the other end on high voltage potential, and the end on high voltage potential is mechanically connected to the breaking unit, and a fiber optic sensor for sensing the current through the breaking unit. The supporting insulator is removably connected to the breaking unit. The sensor has an optic fiber coil arranged in the high voltage end of the supporting insulator, and the circuit breaker includes a mechanism for conducting current from the breaking unit to the sensor so that the current passes through the sensor coil.

7 Claims, 3 Drawing Sheets

CIRCUIT BREAKER

CROSS-REFERENCE TO RELATED APPLICATIONS

The present application is a continuation of pending International patent application PCT/EP2007/064320 filed on Dec. 20, 2007 which designates the United States and claims priority from European patent application 06445080.2 filed on Dec. 29, 2006, the content of which is incorporated herein by reference.

FIELD OF THE INVENTION

The present invention generally relates to a circuit breaker in high voltage applications above 50 kV. The invention is more particularly directed to a circuit breaker provided with a current sensor for measuring the current through the circuit breaker.

BACKGROUND OF THE INVENTION

Electrical power transmission networks are protected and controlled by circuit breakers. Such circuit breakers are divided into two classes: Live tank circuit breakers where the enclosure that contains the breaking mechanism is at line potential, that is, "Live", and Dead tank circuit breakers where the enclosures are at earth potential.

A circuit breaker for high voltage applications comprises at least one breaking unit and a supporting insulator having one end adapted for connection to a ground potential and the other end adapted for connection to a high voltage potential. The supporting insulator is mechanically connected to the high potential end of the breaking unit(s). The breaking unit includes an interruption chamber housing a movable and a stationary contact.

There is a need to monitor different operating parameters of the circuit breaker, such as the current conducted by the circuit breaker. To this end, it is known to provide the circuit breaker with some kind of measuring device. One kind of measuring device that has come into use recently is the so-called fiber optic current sensor, which works according to the following principles. Magnetic field through a medium changes the polarization of light. By conducting light from the medium by means of an optical fiber to an analyzer and analyzing the polarization, the magnetic field, which is directly proportional to current flowing through the medium, can be determined with high accuracy.

Such arrangements are well known for instance in WO 00/08664 and U.S. Ser. No. 368,567. In all these cases the optical sensors are placed inside the interruption chamber of the circuit breaker. However circuit breakers need maintenance, such as replacing the contacts. It is then necessary to disassemble the circuit breaker. Fiber optic current sensors, which are placed inside the interruption chambers will then be affected. Sometimes the entire breaking units are replaced. Furthermore, large circuit breakers need to be transported separated in parts and the breaking unit will be assembled to the supporting insulator in the switchyard. The optic fibers then must be assembled in the switchyard, often outdoors, which is extremely inconvenient and can jeopardize the accuracy of the fiber optic current sensor.

It is therefore an advantage if the fiber optic current sensor can be placed in a position where its optical connection will not at all be affected when the breaking unit is disassembled from or assembled to the supporting insulator.

GB864,835 shows a circuit breaker having an electrical current sensor, including a current transformer, for measuring the current through the circuit breaker. The current transformer is provided in the lower end of the supporting insulator, which is adapted for connection to a ground potential. The current from the breaking unit is led through the entire supporting insulator to the current sensor located in the lower end of the supporting structure. This is a disadvantage since it requires full high voltage insulation between the primary current path in the circuit breaker and a lower flange in the lower part of the supporting insulator. This full insulation is expensive and complicates the manufacturing of the circuit breaker.

SUMMARY OF THE INVENTION

An object of the present invention is to provide a circuit breaker having a fiber optic sensor for sensing the current through the breaking unit, which is easy to assemble and disassemble.

This object is achieved with a circuit breaker having a supporting insulator which is removably connected to the breaking unit, the sensor has an optic fiber coil arranged in the high voltage end of the supporting insulator, and the circuit breaker comprises means for conducting current from the breaking unit to the sensor so that the current passes through the sensor coil.

As the sensor is positioned in the supporting insulator, it is possible to assemble and disassembled the interrupter chamber of the circuit breaker without affecting the sensor system. A further advantage with the invention is that no insulation of the sensor is needed, as the sensor coil is located in the high voltage part of the supporting insulator and the collecting fibers of the sensor coil are good electrical insulators itself. Also, the length of the current path in the supporting insulator is considerably reduced compared to the current path in the circuit breaker disclosed in GB864,835, since the current path does not needed to extend through the entire supporting insulator to the lower part of the supporting insulator.

Further preferred embodiments are defined by the dependent claims.

BRIEF DESCRIPTION OF THE DRAWINGS

The invention is now described, by way of example, with reference to the accompanying drawings, in which.

DETAILED DESCRIPTION OF THE INVENTION

In the following a detailed description of preferred embodiments of the present invention will be given. In this description, the term "high voltage" will be used for voltages of 1 kV and higher.

Figure 1:
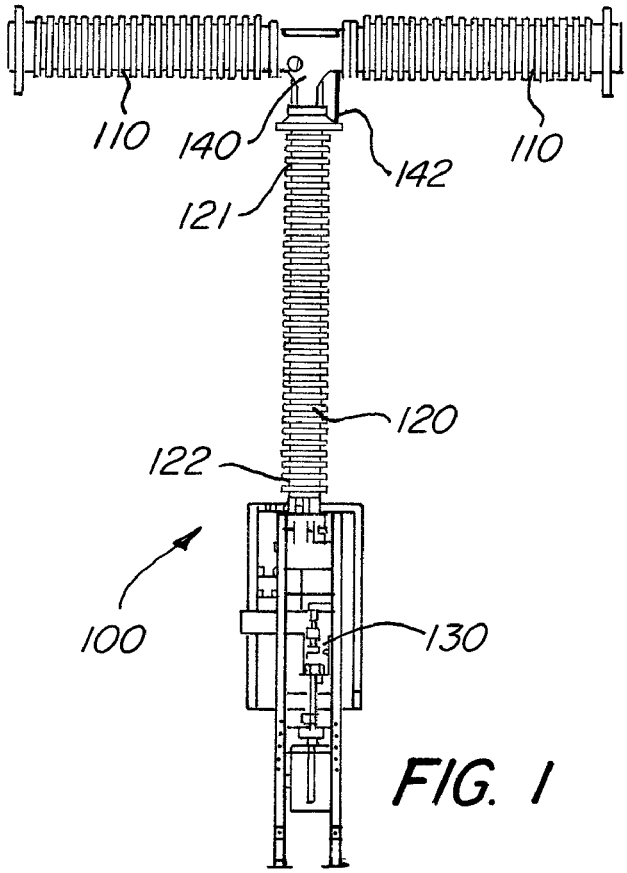
FIG. 1 is an overview of a first embodiment of a circuit breaker according to the invention.

FIG. 1 shows an overview of a circuit breaker according to the invention, generally referenced 100. The described circuit breaker is a so-called disconnecting circuit breaker, but the invention is also applicable to other high voltage circuit breakers, wherein a current sensor is used to measure current through the device.

Figure 3:
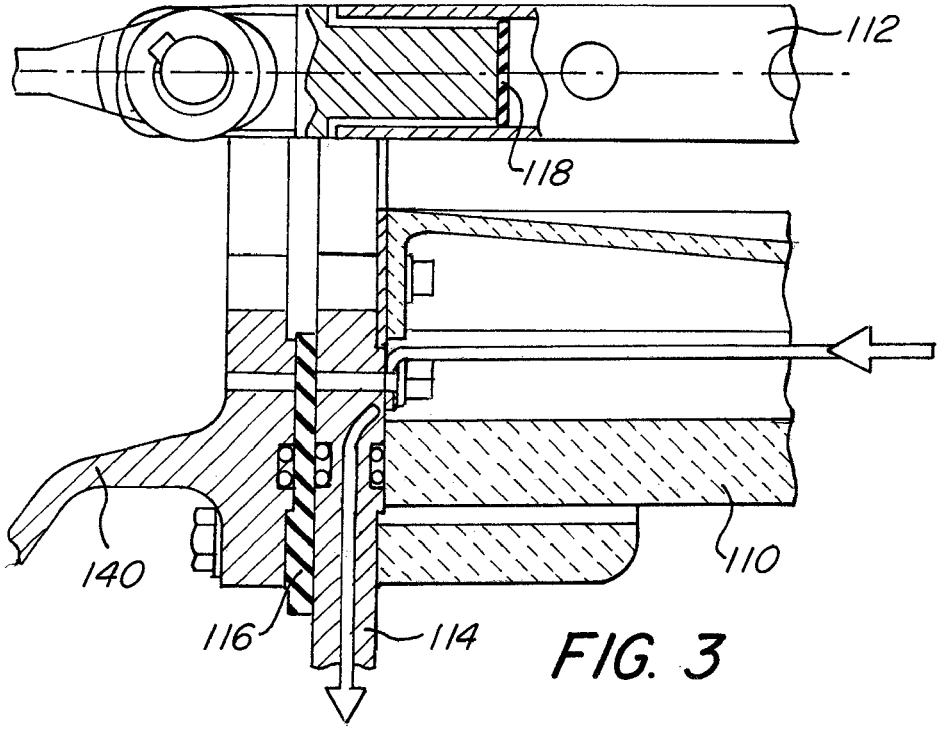
FIG. 3 is a detailed sectional view of the interface between a breaking unit and the top mechanism house in the area of FIG. 2 denoted III.

The circuit breaker 100, which is a double unit breaker, comprises two horizontal serially connected breaking units 110, each comprising a breaker arranged to interrupt high current under control of a control unit 130 by separating two contacts in medium, such as sulfur hexafluoride ($SF_6$), having excellent dielectrical and arc quenching properties. The contacts are operated by means of an operating rod 112, see FIG. 3. The breaking units are at live voltage and the circuit breaker is thus of the so-called live tank circuit breaker type.

The breaking units 110 are mechanically supported by a vertical supporting insulator 120, which insulates the breaking units from ground. The supporting insulator has one end 121 at high voltage potential and the opposite end 122 at ground potential. The high voltage end of the supporting structure is mechanically connected to the breaking units 110. The insulator comprises a hollow cylindrical housing of porcelain or polymeric composite material.

Figure 2:
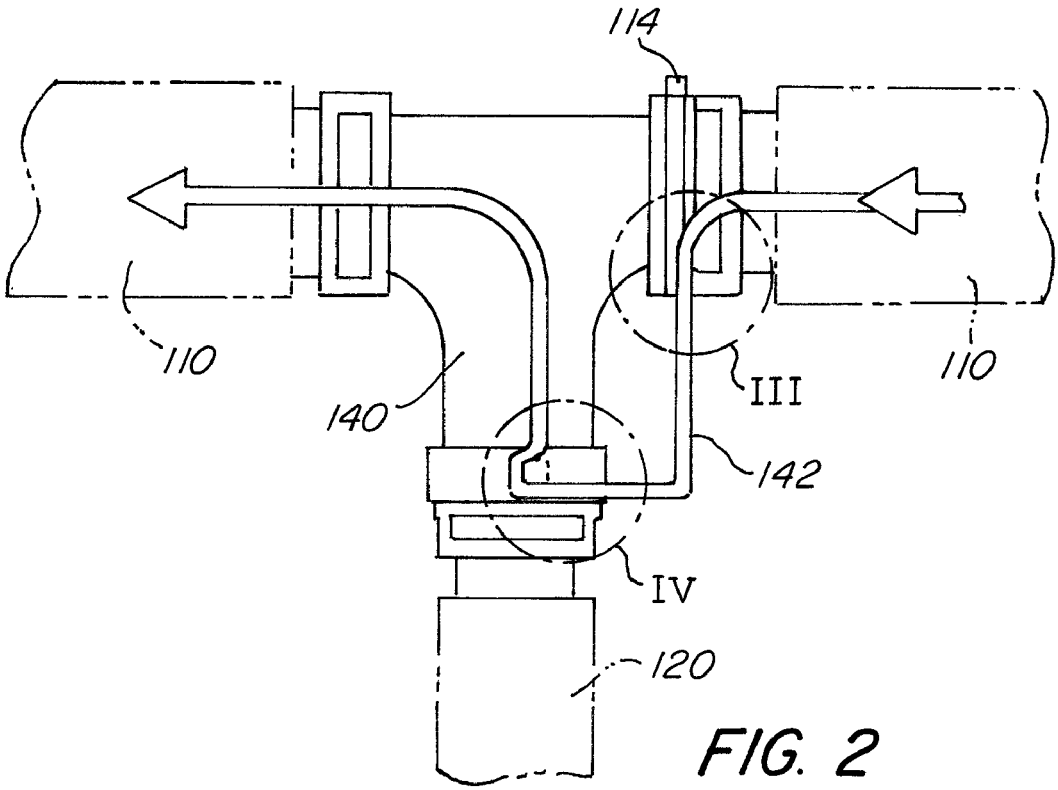
FIG. 2 shows a top mechanism house comprised in the circuit breaker of FIG. 1.

The two breaking units 110 and the supporting insulator 120 are mechanically interconnected by means of a top mechanism house 140, a sectional view of which is shown in FIG. 2. In a conventional prior art circuit breaker, the current path goes directly through the top mechanism house from one breaking unit to the other. However, in the circuit breaker according to the invention, the current path is interrupted between one breaking unit 110, in the shown embodiment the right breaking unit, and the top mechanism house 140. This is achieved by means of an additional flange 114 that is provided between the right one of the breaking units 110 and the top mechanism house 140. This flange 114 is insulated from the top mechanism house by an insulation in the form of an insulating disc 116, see FIG. 3. All bolts holding the breaking unit 110 must be insulated from the flange of the top mechanism house 140. The operating rod 112 must also be insulated by a sleeve 118 in order to avoid shunting currents that would cause measuring errors.

The circuit breaker includes a fiber optic sensor for sensing the current through the breaking units 110. The sensor has an optic fiber coil 150 arranged in the high voltage end 121 of the supporting insulator. The current is transferred in a bypass connector 142 to the sensor coil 150 provided in the upper portion of the supporting insulator 120, see FIG. 4, wherein the central axis of the circuit breaker is shown by a vertical dash-dotted line. The current from the bypass connector is led to an additional flange 122, which is attached to the supporting insulator 120. This additional flange 122 on top of the supporting insulator 120 is electrically insulated from the top mechanism house 140 by means of an insulating disc 124. The sensor coil 150 is placed in a groove in the additional flange 122 and two spiral contacts 126 will transfer the current to a cylinder 128 and further to the top mechanism house 140 and to the second breaking unit so that the current will pass through the sensor coil 150.

An optical fiber 152 interconnecting the sensor coil 150 and evaluation opto-electronics provided in the control house 130 is provided in a suitable way, such as inside the supporting insulator cylinder, thereby being protected against the environment and other hazards. However, the optical fiber could also be provided in the insulator cylinder material.

Figure 4:
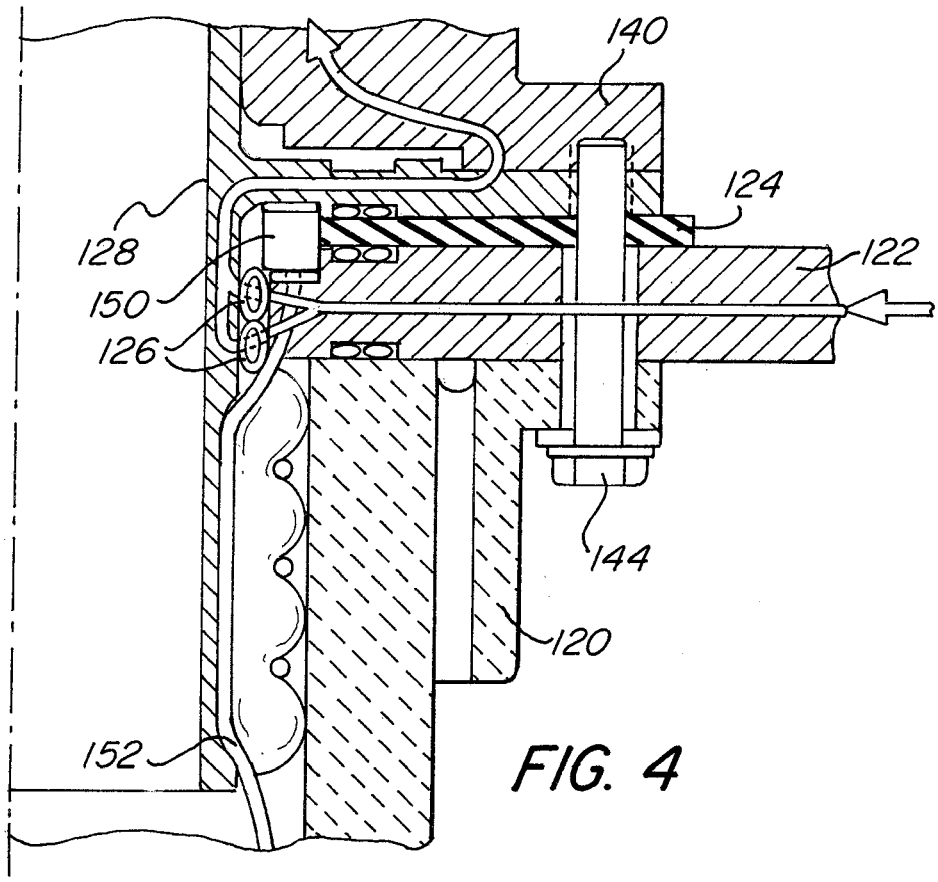
FIG. 4 is a detailed sectional view of the interface between a supporting insulator and the top mechanism house in the area of FIG. 2 denoted IV.

The top mechanism house 140 is removably attached to the supporting insulator 120 by means of a plurality of screws 144, one of which is shown in FIG. 4, extending through a respective hole in the supporting insulator 120 and in the additional flange 122. By removing the screws 144, the top mechanism house 140 can be removed from the supporting insulator 120 during maintenance, for example. Since the sensor coil 150 is provided in the supporting insulator 120 and not in the top mechanism housing or in one of the breaking units, the removal of the top mechanism house will not mechanically affect the sensor.

Figure 5:
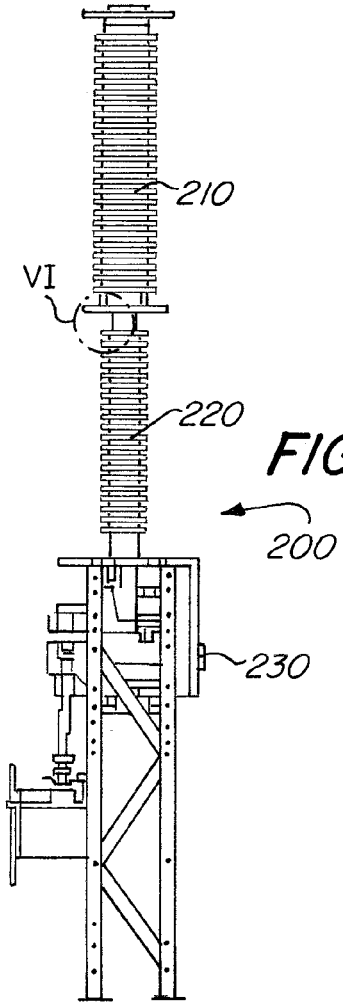
FIG. 5 is an overview of a second embodiment of a circuit breaker according to the invention.

A second embodiment of a circuit breaker according to the invention will now be described with reference to FIGS. 5 and 6. This circuit breaker, generally referenced 200, which is a single unit disconnecting circuit breaker, comprises a vertical breaking unit 210 comprising a breaker arranged to interrupt high current under control of a control unit 230 by separating two contacts in medium, as in the first embodiment. The breaking unit 210 is mechanically supported by a vertical supporting insulator 220, which insulates the breaking unit from ground. The insulator comprises a hollow cylindrical housing of porcelain or polymeric composite material.

The breaking unit 210 and the supporting insulator are mechanically interconnected by means of a flange arrangement, which will be described in detail with reference to FIG. 6, wherein the central axis of the circuit breaker is shown by a vertical dash-dotted line.

Figure 6:
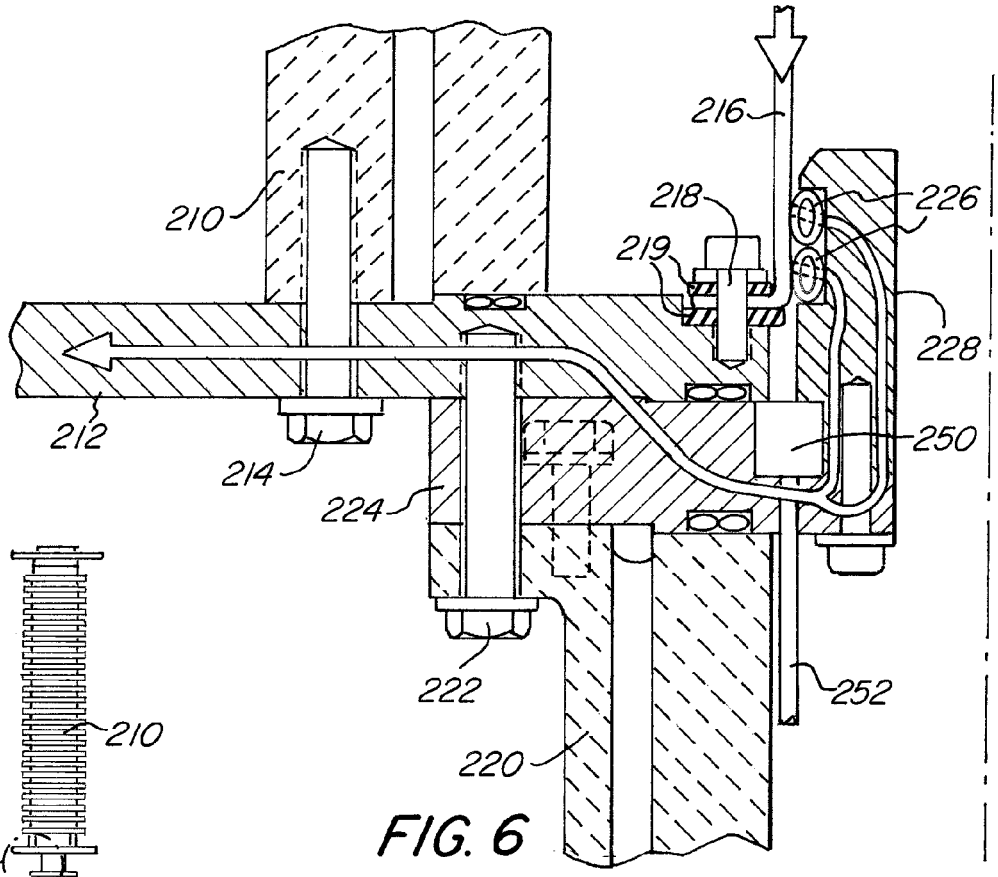
FIG. 6 is a detailed sectional view of the interface between a supporting insulator and a breaking unit of the disconnecting circuit breaker of FIG. 5, denoted VI.

The breaking unit 210 is attached to the supporting insulator 220 by means of a terminal flange 212 which is attached to the breaking unit by means of a plurality of screws 214, one of which is shown in FIG. 6. The terminal flange 212 is also attached to the supporting insulator 220 by means of a plurality of screws 222, one of which is shown in FIG. 6. In order to electrically insulate the current path, indicated by an arrow, in the current conductor 216 of the breaking unit from going directly to the terminal flange 212, the screw 218 which connects the current conductor 216 and the terminal flange 212 is electrically insulated from the current conductor 216 by means of an insulator element 219. An additional flange 224 is instead provided between the terminal flange 212 and the supporting insulator 220. A sensor coil 250 is provided in this additional flange 224. Two spiral contacts 226 will transfer the current from the current conductor 216 to a cylinder 228, which is connected to the additional flange 224, thus leading the current through the sensor coil.

The optical fiber interconnecting the sensor coil 250 and evaluation opto-electronics provided in the control house 230 is like in the first embodiment.

The breaking unit 210 can be removed from the supporting insulator 220 by removing the screws 222. Since the sensor coil 250 is provided in the supporting insulator 220, this removal of the breaking unit 210 will not mechanically affected the sensor coil and mechanical adjustments thereof is thereby avoided.

What is claimed is:

1. A circuit breaker for high voltage applications, comprising:

at least one breaking unit, a supporting insulator having one end on ground potential and the other end on high voltage potential, and the end on high voltage potential is mechanically connected to the breaking unit, and a fiber optic sensor for sensing current through the breaking unit, characterized by the supporting insulator is removably connected to the breaking unit, said sensor has an optic fiber coil arranged in the high voltage end of the supporting insulator, and the circuit breaker comprises means for conducting current from the breaking unit to the sensor so that the current passes through the sensor coil, said means for conducting the current comprising at least one insulator element arranged to prevent the current from flowing directly from the breaking unit to a terminal flange, and a bypass connector conducting the current from the breaking unit to pass through the sensor and then further to the terminal flange.

2. The circuit breaker according to claim 1, wherein the circuit breaker is a disconnecting circuit breaker.

3. The circuit breaker according to claim 1, wherein current from the at least one breaking unit is conducted to an additional flange connected to the supporting insulator.

4. The circuit breaker according to claim 3, wherein the sensor is provided in the additional flange.

5. The circuit breaker according to claim 1, comprising spiral contacts for transferring current to the sensor.

6. The circuit breaker according to claim 1, comprising a current conductor which is insulated from the terminal flange to divert current to the supporting insulator.

7. The circuit breaker according to claim 1, comprising an additional breaking unit and a house interconnecting the at least one breaking unit, the additional breaking unit, and the supporting insulator, and an insulation between the at least one breaking unit and the house to divert current to the supporting insulator.

* * * * *